United States Patent [19]

La Bate

[11] 4,121,805

[45] Oct. 24, 1978

[54] SELF ADJUSTING CONSUMABLE HOT TOP FOR INGOT MOLDS

[76] Inventor: Micheal Donald La Bate, 115 Hazen Ave., Ellwood City, Pa. 16117

[21] Appl. No.: 753,313

[22] Filed: Dec. 22, 1976

[51] Int. Cl.[2] ..... B22D 7/10

[52] U.S. Cl. ..... 249/197; 249/106; 249/198

[58] Field of Search ..... 249/197–202, 249/106

[56] References Cited

U.S. PATENT DOCUMENTS

| | | | |
|---|---|---|---|
| 3,478,999 | 11/1969 | Charman, Jr. et al. | 249/201 |
| 3,797,801 | 3/1974 | Mueller | 249/197 |
| 3,897,930 | 8/1975 | Young | 249/202 |
| 3,904,166 | 9/1975 | Wadsworth | 249/197 |

FOREIGN PATENT DOCUMENTS

| | | | |
|---|---|---|---|
| 2,032,368 | 4/1971 | Fed. Rep. of Germany | 249/197 |

*Primary Examiner*—Robert L. Spicer, Jr.
*Attorney, Agent, or Firm*—Webster B. Harpman

[57] ABSTRACT

A self adjusting consumable hot top is formed of a pair of bendable shape adjusting sections of a combustible consumable material capable of being wedged into opposed relation in an ingot mold so that the hot top conforms with the shape of the cavity in the ingot mold and when ignited by molten metal poured therein adds heat to the molten metal to maintain a pool of molten metal for filling pipes and cracks in the cooling ingot.

3 Claims, 3 Drawing Figures

SELF ADJUSTING CONSUMABLE HOT TOP FOR INGOT MOLDS

BACKGROUND OF THE INVENTION

1. Field of the Invention

This invention relates to consumable hot tops positioned in the upper ends of ingot molds for insuring the maintenance of a pool of molten metal in the cooling ingot cast in the mold.

2. Description of the Prior Art

Prior hot top constructions have generally comprised assemblies of four relatively rigid sections assemble and positioned in the ingot mold and held therein by various devices. See for example U.S. Pat. No. 1,501,655, 3,202,395 and 3,897,930. Consumable hot tops formed of slabs hinged to one another are seen in U.S. Pat. Nos. 3,797,801 and 3,857,160. The present invention comprises an improvement in the art in providing a hot top which is capable of adapting its shape to the shape of the cavity in the ingot mold in which it is being installed and of being wedged in position insuring its retention of its mold cavity matching configuration.

SUMMARY OF THE INVENTION

The self adjusting consumable hot top formed of a pair of elongated rectangular sections of suitable consumable material are provided with spaced vertical grooves permitting the sections of material to be arranged in oppositely disposed U-shapes for positioning in the upper end of an ingot mold, means for holding the U-shapes in installed position are provided and the ends of the U-shapes are arranged to receive and retain wedges which are driven therebetween to force the U-shapes to conform to the configuration of the cavity of the ingot mold.

DESCRIPTION OF THE PREFERRED EMBODIMENT

Figure 1:
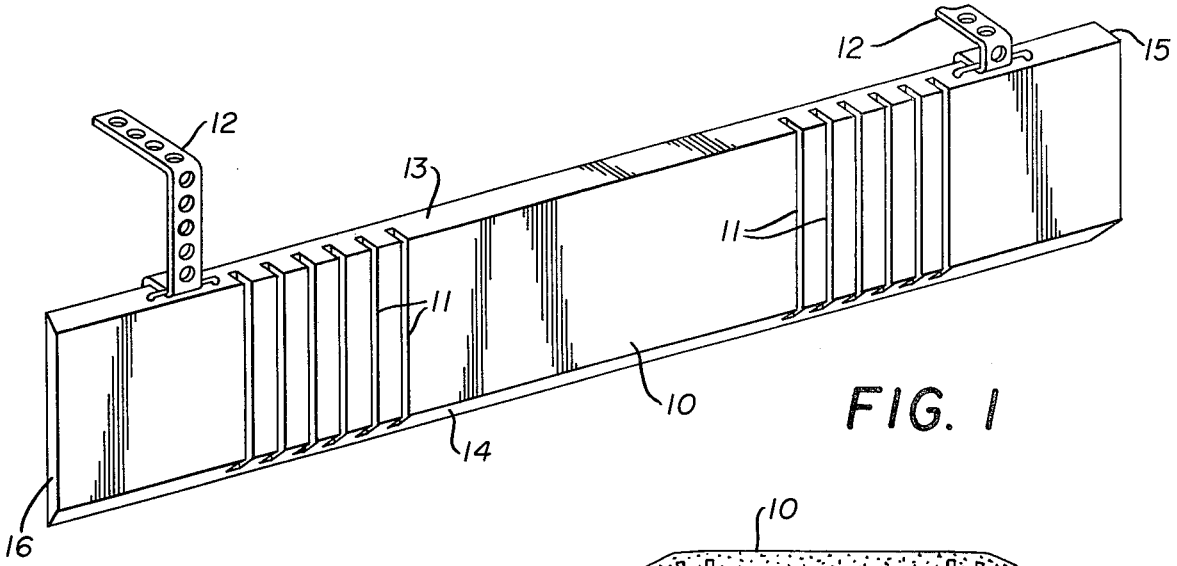
FIG. 1 is a perspective elevation of one portion of a hot top formed in accordance with this invention.
Figure 2:
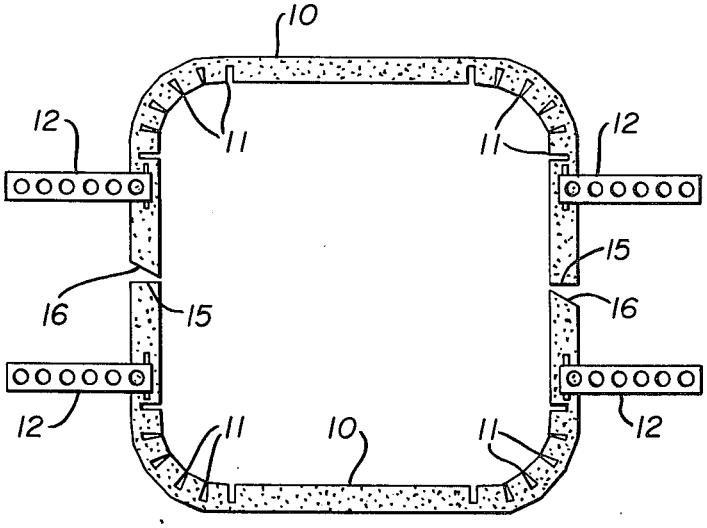
FIG. 2 is a top plan view showing two of the portions of the hot top as seen in FIG. 1 shaped into U-shapes for positioning in an ingot mold.

In the form of the invention chosen for illustration and description herein, the consumable hot top comprises a pair of elongated rectangular portions 10 as seen in FIG. 1 of the drawings, each of said sections 10 having a plurality of spaced vertical grooves 11 formed therein inwardly of its ends and generaliy in the sections thereof which will correspond with the curved corners of the section when it is installed in an ingot mold as illustrated in FIG. 2 of the drawings.

Figure 3:
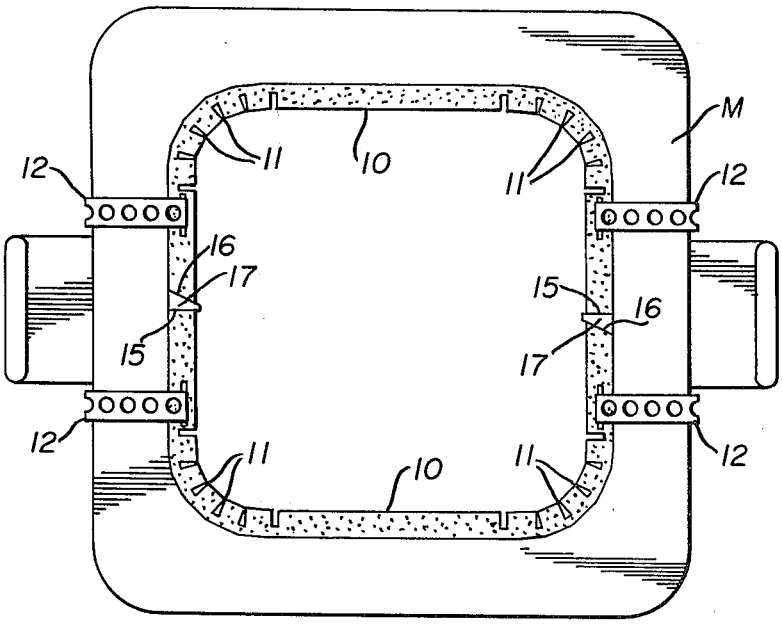
FIG. 3 is a top plan view of an ingot mold showing the hot top of the invention installed therein.

Still referring to FIG. 1 of the drawings, it will be seen that the portion 10 of the ingot mold has a pair of bendable hangers 12 secured to its upper edge 13 inwardly of the ends thereof, the hangers 12 being adapted to be bent outwardly and over the upper end surfaces of an ingot mold M as seen for example in FIG. 3 of the drawings, so that they will support the portion 10 therein. The lower longitudinal edge of the portion 10 of the ingot mold is tapered upwardly and inwardly as at 14 and one end of the portion 10 has a right angular end configuration 15 while the other opposite end portion has a tapered end surface 16. The portion 10 of the hot top is formed of any resilient combustible consumable material such as known in the art and for example shaped of a mixture consisting essentially of about 15% by weight of sawdust, about 54% by weight of dolomite and about 31% by weight of sodium silicate. It will occur to those skilled in the art that if desired an exothermically reactive material such as thermite may be added to the material from which the hot top is formed in an amount sufficient to maintain a desired elevated temperature for a predetermined time. Such a mixture can thus consist of about 15% sawdust, about 54% dolomite and about 3% sodium silicate together with a known amount of the exothermic reactive material, such as thermite.

The hot top may also be formed of a mixture varying somewhat from the foregoing by substituting paper pulp and rock wool for some of the sawdust and silica flour for some of the dolomite and sodium silicate. Various percentages of these other materials are usable with the rock wool serving as a fiber increasing the resilient strength of the portions of the hot top incorporating the same.

By referring now to FIG. 2 of the drawings it will be seen that two of the portions 10 of the hot top disclosed herein have been bent into substantial U-shapes and arranged in oppositely disposed relation with the grooves 11 in the portions 10 enabling the same to form curved corners in the hot top. The hangers 12 are shown bent outwardly in oppositely disposed relation so that they will overlie the top of an ingot mold and thereby support the oppositely disposed U-shaped half sections of the hot top formed of the portions 10. The ends of the portions 10 will be seen to provide wedge receiving and retaining configurations, the tapered ends 16 being directly opposed by the right angular ends 15.

By referring now to FIG. 3 of the drawings, the hot top formed of the U-shaped portions 10 may be seen positioned in the upper end of an ingot mold M with the hangers 12 positioned outwardly over the top thereof and bent downwardly over the edge of the mold 10 so as to retain the U-shaped portions 10 of the ingot mold in such position. Wedges 17, which are elongated cross sectionally triangular shaped members, are then driven downwardly between the ends 15 and 16 so as to move the U-shaped portions 10 of the hot top oppositely with respect to one another sufficiently to forcefully engage the inner walls of the cavity in the ingot mold M. In so doing the flexible or resilient characteristics of the material of the portions 10 of the hot top will enable the same to conform to the exact configurations of the ingot mold in which they are positioned so as to prevent hot metal subsequently poured in the ingot mold from moving into any space between the hot top and the inner surface of the cavity of the mold.

Those skilled in the art will observe that the hot top thus formed is selfadjusting as to the shape of the cavity in the ingot mold in which it is positioned and self-retaining therein to a very great degree. The arrangement and configuration of the grooves 11 contributes substantially to the ability of the portions 10 of the hot top to conform to the shape of the cavity in the ingot mold in which they are installed and also contributes to their ability to remain in desired position as the resilient flexibility of the corner sections of the hot top tends to a straightening action, all of which applies additional holding pressure against the surface of the cavity in the ingot mold M.

It will thus be seen that an improved consumable hot top has been disclosed which may be easily and relatively inexpensively formed, shipped flat in identical portions and easily assembled into appropriately shaped hot tops at the point of use and positioned in an ingot mold and quickly and easily wedged therein so that they conform to the configuration of the cavity in the ingot mold.

Although but one embodiment of the present invention has been illustrated and described, it will be apparent to those skilled in the art that various changes and modifications may be made therein without departing from the spirit of the invention and having thus described my invention what I claim is.

I claim:

1. A consumable hot top for installation in the upper end of an ingot mold and comprising a pair of elongated rectangular portions of combustible consumable resilient material, each of said elongated rectangular portions having an outer surface and an inner surface with a pair of spaced groups of corner forming transversely extending deep grooves defined in said inner surfaces, each group of corner forming grooves including a plurality of grooves formed therein inwardly of the ends thereof, and each group being located near an end of said each rectangular portion to be positioned adjacent a corner of an ingot mold thereby forming a corner in said each rectangular portion which corresponds to an ingot mold corner with said each portion assuming the shape of a U, bendable hangers attached to one of the longitudinal edges of each of said elongated rectangular portions adjacent the ends thereof and located between said corner forming grooves and the rectangular portion ends, and one of the ends of each of said elongated rectangular portions being formed at a first angle and the other end of said each rectangular portion being formed at a second angle, said second angle being other than a right angle, said first and second angles being selected so that an angle formed when said one end of one rectangular portion is adjacent another end of another rectangular portion an angle formed by said ends opens toward said outer surfaces, said portions arranged to be positioned in oppositely disposed relation to one another in said ingot mold to form said hot top so that the one end of one portion is opposed with said second angle to form a triangular wedge receiving area between opposed ends of said elongated rectangular portions, said triangular areas being located between the corners of a mold and forming a triangular volume with an inner surface of the mold, and elongated cross sectionally triangular members located in said triangular volumes and contacting the opposite angularly disposed ends of said U-shaped portions for shaping and holding the resilient portions of the hot top in contact with the walls of said ingot mold.

2. The consumable hot top of claim 1 and wherein said rectangular portions are formed of a compound consisting of about 15% sawdust, about 54% dolomite and about 31% sodium silicate.

3. The consumable hot top of claim 1 and wherein said rectangular portions are formed of a compound consisting of about 15% sawdust, about 54% dolomite and about 3% sodium silicate together with a known amount of an exothermic reactive material such as thermite.

* * * * *